US009289036B2

(12) United States Patent
Catheline et al.

(10) Patent No.: US 9,289,036 B2
(45) Date of Patent: Mar. 22, 2016

(54) WATCHSTRAP MADE OF HINGED LINKS

(75) Inventors: Adrien Catheline, Valleiry (FR); Benjamin Celant, Arenthon (FR); Jérôme Tyrode, Gaillard (FR)

(73) Assignee: ROLEX SA, Geneva (CH)

( * ) Notice: Subject to any disclaimer, the term of this patent is extended or adjusted under 35 U.S.C. 154(b) by 562 days.

(21) Appl. No.: 13/322,683

(22) PCT Filed: May 26, 2010

(86) PCT No.: PCT/CH2010/000137

§ 371 (c)(1),
(2), (4) Date: Dec. 7, 2011

(87) PCT Pub. No.: WO2010/142049

PCT Pub. Date: Dec. 16, 2010

(65) Prior Publication Data

US 2012/0069720 A1 Mar. 22, 2012

(30) Foreign Application Priority Data

Jun. 8, 2009 (EP) ..... 09405098

(51) Int. Cl.
*A44C 5/00* (2006.01)
*A44C 5/10* (2006.01)

(52) U.S. Cl.
CPC ..... *A44C 5/107* (2013.01)

(58) Field of Classification Search
None
See application file for complete search history.

(56) References Cited

U.S. PATENT DOCUMENTS

| | | | | |
|---|---|---|---|---|
| 4,429,785 | A * | 2/1984 | Dango | 198/852 |
| 4,930,304 | A | 6/1990 | Meister | |
| 5,347,498 | A | 9/1994 | Loth et al. | |
| 6,406,177 | B1 * | 6/2002 | Fukushima et al. | 368/281 |
| 7,191,586 | B2 * | 3/2007 | Yamamoto | 59/82 |
| 2002/0009019 | A1 | 1/2002 | Gunster et al. | |
| 2004/0184358 | A1 * | 9/2004 | Hiranuma et al. | 368/282 |
| 2009/0113870 | A1 | 5/2009 | Rejzner | |
| 2013/0056507 | A1 * | 3/2013 | Leung | 224/164 |

FOREIGN PATENT DOCUMENTS

| | | | |
|---|---|---|---|
| CH | 695389 | A5 * | 4/2006 |
| EP | 0347841 | A1 | 12/1989 |
| EP | 0586981 | A1 | 3/1994 |
| EP | 1048240 | A1 | 11/2000 |
| EP | 2057914 | A1 | 5/2009 |
| FR | 2727168 | A1 | 5/1996 |
| GB | 2260072 | A | 4/1993 |

OTHER PUBLICATIONS

International Search Report of PCT/CH2010/000137, mailing date Nov. 16, 2010.
Written Opinion of the International Searching Authority Application No. PCT/CH2010/000137 (Form PCT/IB/237), with form PCT/IB/373, date of mailing Dec. 12, 2011.

* cited by examiner

*Primary Examiner* — Jack W Lavinder
(74) *Attorney, Agent, or Firm* — Westerman, Hattori, Daniels & Adrian, LLP

(57) ABSTRACT

The invention relates to a watchstrap (1) including a plurality of mutually hinged elements (7) which each comprise at least one link (2, 3, 4, 4') and at least one recess consisting of at least one hole (15, 15') for receiving therein a linking member (10, 11, 12). Next to the open ends (16) of at least some of said holes (15, 15'), a clearance (20) of the linking member (10, 11, 12) is provided, preventing any contact at said point between the latter and said links (2, 3, 4, 4').

22 Claims, 4 Drawing Sheets

WATCHSTRAP MADE OF HINGED LINKS

BACKGROUND ART

The present invention concerns a bracelet made of articulated elements, in particular links at least some of which are preferably produced at least in part in a material of low impact resistance. The invention is also directed to a particular use of such a bracelet for watches, jewelry, or even ornaments.

The incorporation in bracelets of materials that are hard and generally have a low impact resistance, namely materials sensitive to mechanical shock, is essentially intended to confer great durability (resistance to scratching and wear) and esthetic added value to the object to which they are fitted. The latter generally consists of a metallic armature that is needed in order to be able to resist high accidental mechanical loads, such as those that occur if it is dropped.

In contrast to metals and alloys obtained by casting, materials such as those produced by solidification at high temperature of a paste or compressed powder generally have a low impact resistance and are therefore particularly sensitive to mechanical shocks. This sensitivity is the result of the absence of plastic deformation of these materials on impact. This means that parts constructed from such materials suffer what is called brittle fracture.

Materials defined as fragile under normal temperature conditions and at low impact speeds include for example sintered hard metals, all types of ceramic including zirconia, glass, and minerals such as sapphire and ruby.

The documents EP 586 981 and EP 347 841 describe bracelets consisting of links, notably for watchstraps, the visible parts of which are formed of decorative elements produced in hard materials, such as ceramics or sintered hard metals. The bracelet includes an armature consisting of link assemblies in a material that can be machined, such as steel. In both cases, ceramic elements are intended only to cover the links of the armature, which is what withstands all mechanical forces applied to the bracelet. Thus the mechanical stresses to which the decorative elements are subjected are greatly limited.

The document US 2002/0009019 suggests another bracelet construction formed of a succession of ceramic links each forming an entity constituted of a central link bordered by two lateral links offset relative to the former. These three links are held together by a pin threaded at its ends, which are intended to be screwed into threads molded into the lateral links. The articulation and assembly of the successive link assemblies are obtained by a spring bar passing through the central link and having an elastic member housed in its central part. This member is intended to push apart two tenons slidably mounted at the ends of the bar so that they can be inserted into housings formed in corresponding relationship in the lateral links.

The principal drawback of such a construction stems from the fact that this kind of bracelet suffers from breakage of one or more ceramic links, as it has been possible to confirm during tests reproducing accidental dropping of a watch attached to this type of bracelet. On such dropping, the mass of the watch case plus the watch movement generates large forces on the pins or bars of the bracelet, principally because of a lever arm effect between the point of impact of the bracelet on the floor and the fixing of the bracelet to the watch middle. The break is almost systematically located at the level of the articulation pins of the links. Simulations have shown that high stresses are concentrated in the corners at the entrance to the holes in the ceramic links. It has also been found that all breaks occurred in the direct vicinity of the pins, at the edges of the ceramic links. A broken link or link assembly of such a bracelet renders it unusable and generates non-negligible repair costs through necessitating replacement of the broken element.

SUMMARY OF THE INVENTION

The object of the present invention is to avoid the aforementioned drawbacks by producing, as stated in claim 1, a bracelet comprising a plurality of articulated elements, referred to as link assemblies and each formed of at least one link and including at least one housing intended to receive a linking member associating the links and/or the link assemblies with each other. The design of this bracelet renders the links less sensitive to accidental mechanical shock.

Some links are preferably produced at least in part in fragile materials such as ceramics, sintered hard metals, glass or minerals of sapphire or ruby type, for example. The articulated elements of this bracelet will preferably be engaged in each other so as to be closely linked to each other by the linking members, namely articulation members or pins and where applicable assembly rods. These linking members, of which there are preferably two or three, are housed in the link or links of the link assembly, each in a housing formed of at least one hole in a link.

According to the invention, in the immediate vicinity of the open ends of at least some of the holes in a link, preferably links of low impact resistance and in particular at least holes reserved for the passage of an articulation pin, the linking member is provided with a clearance that, at this location, locally prevents this member from entering into contact with the link. Accordingly, in the preferred embodiment of the invention, each clearance provides in the direct vicinity of the edges of the links from which the linking members project a free space or at least a gap that prevents transmission to these links of the concentrated forces on these members at these ends if the latter are subjected to mechanical loads.

This advantageously prevents breakage of the links which are or become sensitive to mechanical impact by their nature or by virtue of abnormal temperature conditions in which they might be placed.

In the preferred embodiment, the freedom or amplitude of movement reserved in this way for the linking member by this clearance is obtained by reducing its cross section in line with the opening of the hole in the link. Such reduction may be produced by machining in this member a groove that may have different widths and/or profiles as a function of the required performance. Such a member, also known as a grooved pin, will comprise at least as many grooves as there are open ends on all of the fragile links through which it passes.

BRIEF DESCRIPTION OF THE DRAWINGS

Other advantages and specific features of the invention will become apparent in the light of the following description of a preferred embodiment of the invention and variants thereof given by way of nonlimiting example and illustrated diagrammatically and by way of example by the appended figures, in which.

DETAILED DESCRIPTION OF PARTICULAR EMBODIMENTS

Figure 1:
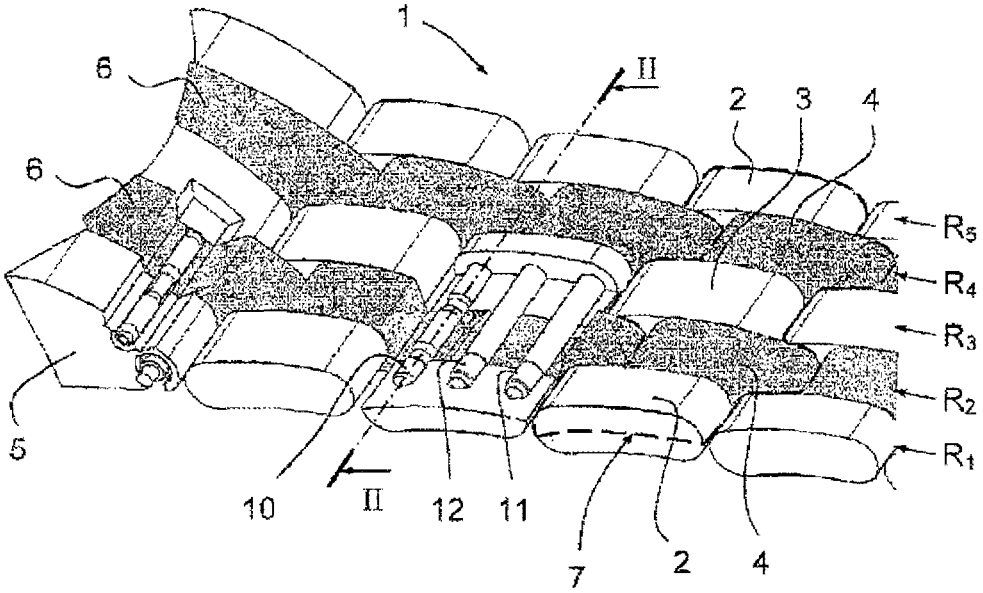
FIG. 1 is a perspective view partly in section of a bracelet portion of the preferred embodiment of the invention.

FIG. 1 shows a bracelet portion 1 in perspective and partly in section. The bracelet represented is a watchstrap produced to a design with five rows $R_1$ to $R_5$ of links 2, 3, 4 forming a plurality of articulated elements. In this arrangement, the so-called edge links 2 situated in the rows $R_1$ and $R_5$ and the so-called center links 3 disposed in the row $R_3$ are judiciously produced in materials that have a high impact resistance, such as metals (steel, gold, titanium, etc.) or alloys. Because of this, the links 4 situated in the rows R2 and R4, referred to as intermediate links, are therefore protected by the adjacent rows of links. For this reason, it is preferably these intermediate links that are chosen to be produced at least in part in materials of low or lower impact resistance. The intermediate links 4 will preferably be fabricated entirely in ceramic, more particularly in zirconia known as being a so-called technical or industrial ceramic. It will of course be understood that other materials could equally be used for the execution of these links. Of these materials, sapphire or ruby will be preferred over sintered hard metal, for example.

The various links 2, 3, 4 are linked together by at least one linking member 10, in particular by three linking members 10, 11, 12 as shown in FIG. 1. With the exception of a few singular link assemblies, such as the fixing bar 5 situated between the horns of the middle of the watch or even the linking link assemblies attached to the clasp of the bracelet, the articulated elements of the bracelet each include at least two linking members, in particular two articulation pins 10. Each of these linking members is common to a plurality of links, notably to all the links of the same link assembly and to some links of the adjacent link assemblies upstream and downstream. In this regard, it is specified that the link assemblies defined in this way correspond to a succession of adjacent links forming a line transverse to the rows $R_1$ to $R_5$. The adjectives upstream and downstream for their part refer to the distance of the element concerned relative to the fixing bar 5 or to the fixing intermediate links 6, which are particular links intended to link the bracelet 1 to the middle of the watch (not shown). Accordingly, relative to a given point, the upstream links will be closer to the fixing bar than the downstream links.

The edge links 2 and the center link 3 of the same link assembly are aligned and retain between them two intermediate links 4 that are offset in the downstream direction relative to this alignment. The combination of these five links forms the entity that will be referred to as a link assembly 7 and is shown in FIG. 1 by the dashed contour line. The link assemblies 7 constitute the articulated elements of the bracelet. They each include at least one link. The links of the same link assembly are held together rigidly, i.e. with no articulation between them, by at least one rod 11 referred to as an assembly rod, preferably by two assembly rods 11 and 12. Given that the link assemblies 7 are all similar to each other and taking into account the positions of the intermediate links 4 offset in the downstream direction, the link assemblies 7 may be interleaved with each other, i.e. interengaged so as to be closely linked, and assembled in the upstream to downstream direction into a chain articulated by means of the pins 10. The latter are specifically defined as articulation pins that confer on two adjacent link assemblies a simple cylindrical articulation comparable to a hinge.

Figure 2:
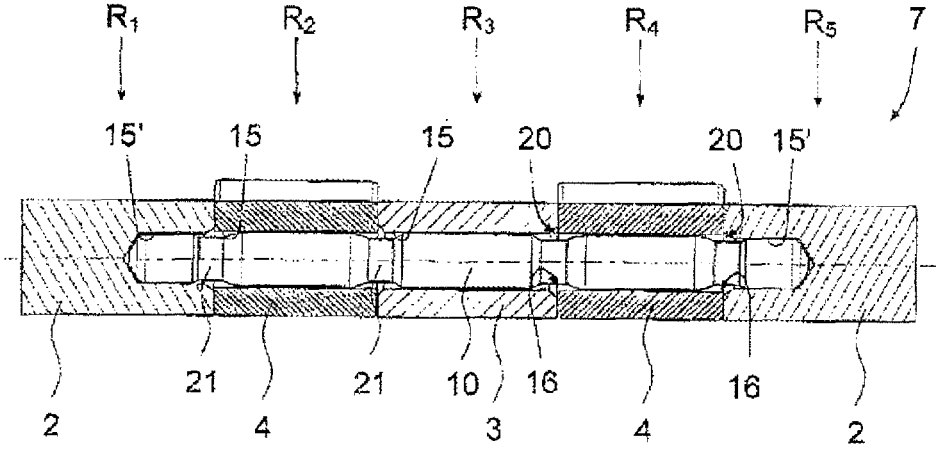
FIG. 2 is a view of the bracelet in vertical section taken along the line II-II in FIG. 1.
Figure 4:
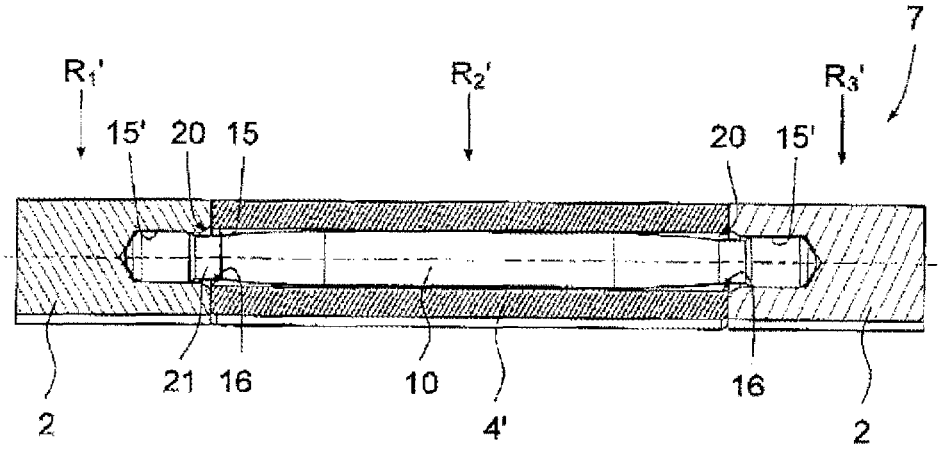
FIG. 4 is a view similar to FIG. 2 but in which the bracelet comprises by way of an alternative only three rows of links.
Figure 5:
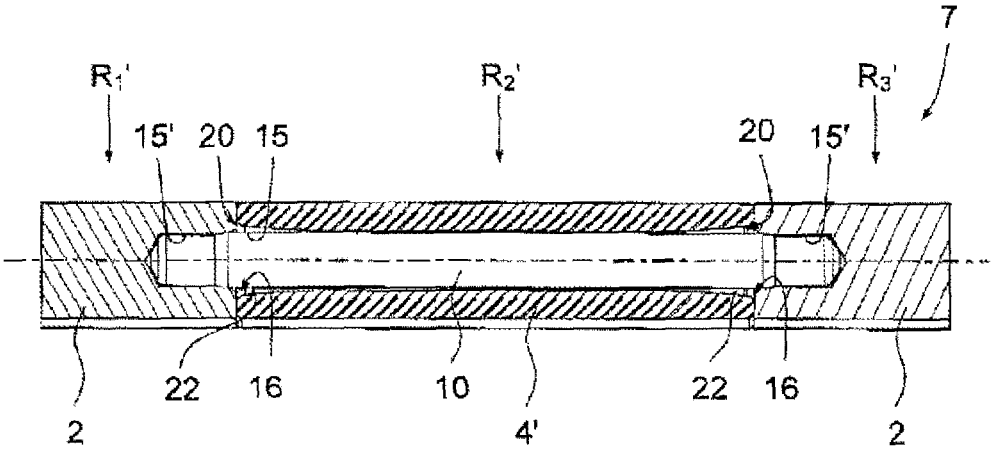
FIG. 5 is a variant of FIG. 4.

The articulated elements 7 each include at least one housing formed of at least one hole 15, seen better in FIGS. 2, 4 and 5, to receive therein a linking member 10, 11, 12. As shown in FIG. 1, these members are preferably hidden inside the links that they link. They are therefore not visible on the exterior faces of the edge links 2 or even between the links 2, 3, 4, given the very small interstitial clearance between these links. The latter are therefore advantageously provided with blind holes 15', whereas the holes 15 of the center links 3 or the intermediate links 4 are of the through-hole type to allow the linking members 10, 11, 12 to pass through them. Generally speaking, the holes 15 and 15' in the same link assembly form a housing for a linking member.

FIG. 2 represents the bracelet with five rows from the previous figure in vertical section taken along the line II-II in FIG. 1. The section taken along this line II-II includes the pivot pin 10. It will be noted that, at least at each open end 16 of the holes 15 provided in the intermediate links 4, in this instance the links referred to as having low impact resistance, there is a clearance 20 of the assembly member that passes through the open ends or mouths of the holes 15. For what it is worth, it is specified that the term mouth, employed here as synonymous with the open end 16 of the hole 15, designates the area situated in the immediate vicinity of the entry or exit of this hole in the link.

In this way, the means that provide the clearance 20 of the linking member in question prevent the latter from coming into contact with the link at a location situated in the vicinity of the opening of the hole in the link. Thus if this pin or linking member is subjected to an elastic deformation stress that would induce local flexing of the corresponding section of that member at the interface of two links or link portions disposed side by side, contact between that section and the link may advantageously be avoided. Because of this, the first bearing point between the link and the linking member is offset in the direction of the central part of the link. By offsetting this bearing point toward the interior of the link, so-called edge effects are avoided that generate high stress concentrations on the link at the location of the openings and would lead to fatigue or premature breaking of the link if the link assembly of the bracelet is subjected to a mechanical shock.

Figure 3A:
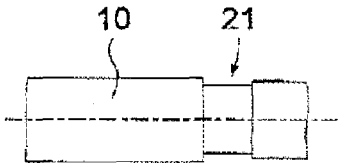
FIGS. 3*a* to 3*d* are views to a larger scale of different groove profiles that the pins and/or rods linking the links or link assemblies of the bracelet may adopt.
Figure 3B:
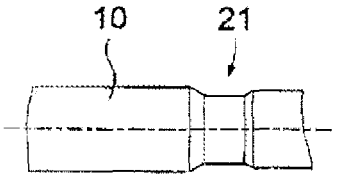
Figure 3C:
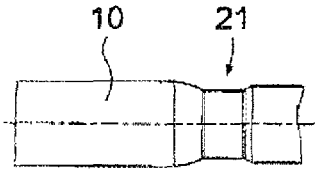
Figure 3D:
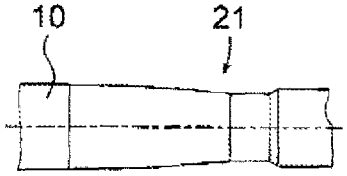

In the preferred embodiment, the clearance 20 is the result of a gap or relief situated between the linking member and the corresponding link. This spacing or separation distance is obtained by reducing the cross section of the linking member in line with the open end 16 by providing on the linking member a groove 21 the profile of which may be that of a straight groove 21, a chamfered groove 21, a groove 21 with rounded edges, a groove 21 with progressive curvature or a groove 21 formed by a combination of these geometries. These various groove shapes are shown by way of example in FIGS. 3*a* to 3*d*. FIGS. 3*c* and 3*d* show combinations in which the groove 21 is chamfered on one side and has on the other side a rounded edge, respectively an edge with progressive curvature. A groove that has a progressive curvature on its side oriented in the direction of the interior of the link advantageously makes it possible, if the portion of the linking member that passes through it is subjected to mechanical stress, to distribute the load on this link gradually over a range extending from its central part as far as the edges of this link. Thanks to this gradual distribution, concentration of forces in the edges of the link may be avoided, or at least limited, in a highly convincing manner.

Such a progressive curvature could be that adopted by the shape of part of a barrel. This shape advantageously makes it possible to load the center of the link more than its edges if elastic deformation occurs in the portion of the assembly member passing through this link. This shape therefore best favors the distribution of mechanical stresses along this portion of this member. Moreover, in terms of mechanical failure, it has been found that the barrel-shape geometry loads the linking members more than the links.

All the linking members 10, 11, 12 will preferably be of circular section and have an outside diameter in the range 1.0 mm to 2.0 mm, more particularly in the range 1.4 mm to 1.6 mm. The diameter at the bottom of the grooves 21 in the grooved pins will be reduced by an amount in the range 5% to 25%, more particularly in the range 11% to 15%, of the outside diameter of the pin. This diameter may furthermore vary along the pin, notably if the diameter of the holes in the center links differs slightly from that of the holes in the edge links. Values equivalent to an outside diameter of 1.5 mm for a groove with a minimum diameter of 1.3 mm will be preferred because they correspond to the best compromise between the strength of the pin and the size of the relief resulting from the groove. In fact, such dimensions make it possible to obtain good performance in terms of impact resistance by leaving a sufficient interstitial space between the bottom of the groove and the edge of the link at the opening of the hole for the pin on flexing of the latter under load. This clearance remains effective in all cases, even taking into account the tolerances applied to the functional dimensions of the hole drilling diameter and the diameters on the pin.

In a variant shown in FIG. 5, the clearance 20 of the pin could be constituted of a free space or relief obtained by providing in the link an entry cone open toward the exterior of the link and situated at the opening of the hole reserved for the assembly member to pass through. Such an entry cone would consist in pronounced flaring or widening of the orifice of the opening of the hole in the link and would also make it possible to reduce, although less effectively, edge effects on this link with a linking member with no groove at its open ends. More generally, this relief could be defined as a flaring 22 of the open end 16. It is further specified that a simple chamfer, like that visible on the links 2 or 3 in FIG. 2, in no way constitutes a relief in the sense in which that term must be understood here, namely a clearance sufficiently effective to fulfill the function that the present invention assigns to it. In fact, the only object of a simple chamfer would be to facilitate engaging the member or to eliminate machining burrs or would simply follow from a constraint in the case of fabrication by means of a molding process, for example.

Figure 6:
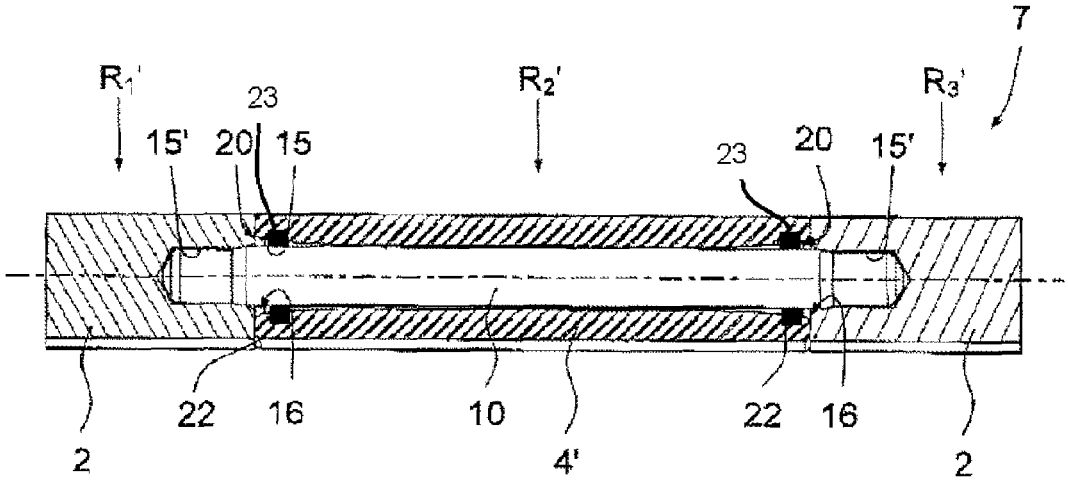
FIG. 6 is another variant of FIG. 4 showing a toroidal or cylindrical member for serving as a damper.

In another embodiment, the clearance could be obtained by a toroidal or cylindrical member such as a sleeve, as illustrated by sleeves 23 in FIG. 6, produced in a material with a very high impact resistance that would serve as a damper. Such a material would thus be capable of absorbing mechanical stresses occurring in the linking member to avoid transmitting them to the link or at least generating a concentration of forces at its edges. To this end, this sleeve could be disposed around the linking member, hidden in the edges of the link, in the vicinity of the open ends of the hole reserved for that member. Alternatively, by placing this sleeve in a groove on the linking member, it would also fill the gap that separates the bottom of the groove from the interior wall or surface at the open end of the hole in the link.

In a combined embodiment, it would be equally possible, in addition to the clearance means 20 constituted by the groove 21 on the linking member, to enlarge the open end of the hole 15 from which this pin projects by means of an entry cone open toward the exterior of the link.

In all cases, the clearance 20 of the assembly member in question aims to distribute any load transmitted to the link as a result of forces induced in the linking member over a range extending from the central part of this link to its edges. For what it is worth, it will be noted that the term clearance as used here defines the amplitude of the possible movement of the linking member, in particular of portions of that member facing the open ends 16, about its equilibrium position defined by the axis of the housing in which it rests.

As shown in FIG. 1, the assembly rods 11 and 12 have no grooves 21 in line with the open ends 16. However, this in no way excludes the provision in the present bracelet 1 of one or more assembly rods 11, 12 similar or identical to the articulation pin 10. More generally, providing for each open end 16 a clearance 20 of the linking member that projects from it could be envisaged. Thus all the assembly members 10, 11, 12 of the links 2, 3, 4 could be members with no grooves 21 as described above. This would further improve the strength and the end performance of the links of the bracelet.

The assembly rods 11, 12 may preferably either have smooth surfaces or be provided with knurled bearing surfaces in order to improve their retention in the links that they link. In particular, such knurled bearing surfaces will preferably be situated at the ends of the assembly rods intended to be housed in the holes 15' in the edge links 2. Also, the assembly rods 11, 12 with no grooves 16 will be driven into the links, unlike the groove pins which, to prevent buckling, will preferably be a snug fit in the holes 15 when being mounted.

FIG. 4 shows a variant design of the links of the bracelet 1 in a view similar to FIG. 2 but in which the arrangement of the links comprises only three rows $R_1'$, $R_2'$, $R_3'$. Thus, although the edge links 2 remain unchanged, the center links and the intermediate links of the same link assembly are replaced here by a single intermediate link 4', preferably produced in a material having a low impact resistance. This figure shows that the present invention is in no way dependent on the arrangement of the links within the various link assemblies of the bracelet, the number thereof or the material in which they are produced.

Thanks to the solution provided by the invention, it has been found during tests carried out on a bracelet as represented in FIG. 1 that the bracelet was capable of resisting stresses stemming from an impact of a watch equipped with this bracelet and weighing 240 g when dropped on to an oak block from a height of 1.3 m. These results have shown that the invention makes it possible to improve performance in terms of the impact resistance of the bracelet by a factor of 2.5 compared to a bracelet in which the articulation pins have no grooves at the openings of the holes in the links through which they pass. For such bracelets the intermediate links are in fact found to break systematically at the level of the articulation pins if dropped from heights of less than 0.5 m.

It will further be noted that the invention has been developed in the first instance to solve the problem of ceramic links breaking in the event of accidental impacts on the bracelet. It will nevertheless be noted that the proposed solution would apply equally well to bracelets in which the links are not particularly sensitive to mechanical impacts. Thus if the links of the bracelet were all produced in metal, for example in steel, gold or any alloy, the solution provided by the present invention would also contribute to avoiding edge effects in the links and thus preserving the open ends of the holes in the connecting members from fatigue resulting from an undesirable concentration of forces.

The invention claimed is:

1. A bracelet comprising:

a plurality of articulated elements, a plurality of links, wherein each of said articulated elements includes at least one of said links, at least one linking member connecting a respective one of said articulated elements with a respective other one of said articulated elements, wherein at least one of said links includes at least one housing including at least one hole, wherein a respective one of said at least one hole receives therein a respective one of said at least one linking member, wherein the respective linking member is housed in the respective hole, the hole comprising a central portion having a cylindrical portion and the linking member comprising a central portion having a cylindrical portion so as to form a simple cylindrical articulation between the respective articulated elements, wherein said at least one of said links has at least a portion made of a material of low impact resistance which is a ceramic, a sintered hard metal, glass or a mineral, said portion including the at least one housing including the at least one hole, wherein a respective clearance is provided at a respective location adjacent a respective open end of said at least one hole to prevent contact at said respective location between said respective linking member and said at least one of said links, so that a bearing point between the link and the linking member in a vicinity of the open end of the hole is offset toward the interior of the link with respect to the open end of the hole, wherein said respective linking member is an articulation pin or an assembly rod having, at said respective location adjacent said respective open end, to obtain said respective clearance, a cross-section having a local reduction compared to a cross-section of said respective linking member at said respective bearing point between said respective linking member and the link.

2. The bracelet as claimed in claim 1, wherein said local reduction has a profile which is that of a straight groove, a chamfered groove, a groove with rounded edges or progressive curvature or a groove formed of a combination of these profiles.

3. The bracelet as claimed in claim 1, wherein said respective open end has a flaring to obtain said respective clearance.

4. The bracelet as claimed in claim 1, wherein a toroidal or cylindrical damper member is disposed between the respective linking member and said at least one of said links at a location of said respective clearance, said damper member being made of a material of higher impact resistance than the material of said portion of said at least one of said links.

5. The bracelet as claimed in claim 4, wherein said respective open end has a flaring to obtain said respective clearance.

6. The bracelet as claimed in claim 1, wherein said respective open end has a flaring.

7. The bracelet as claimed in claim 1, wherein at least another one of said links has at least a portion made of the material of low impact resistance.

8. The bracelet as claimed in claim 7, wherein said material of low impact resistance is sapphire or ruby.

9. The bracelet as claimed in claim 1, wherein said respective linking member is retained by a snug fit in the articulated elements that said respective linking member connects.

10. The bracelet as claimed in claim 1, wherein each of said articulated elements includes an alternation of at least one link having at least a portion made of a first material with a first impact resistance and links each made of a second material having greater impact resistance than that of the first material.

11. Watchstrap comprising the bracelet as claimed in claim 1.

12. Watch comprising the watchstrap as claimed in claim 11.

13. Jewelry item comprising the bracelet as claimed in claim 1.

14. The bracelet as claimed in claim 1, wherein said material of low impact resistance is sapphire or ruby.

15. A bracelet comprising:

a plurality of articulated elements, a plurality of links, wherein each of said articulated elements includes at least one of said links, at least one linking member connecting a respective one of said articulated elements with a respective other one of said articulated elements, wherein at least one of said links includes at least one housing including at least one hole, wherein said at least one hole receives therein a respective one of said at least one linking member, wherein said at least one of said links has at least a portion made of a material of low impact resistance which is a ceramic, a sintered hard metal, glass or a mineral, said portion including the at least one housing including the at least one hole, wherein a respective clearance is provided at a respective location adjacent a respective open end of said at least one hole to prevent contact at said respective location between said respective linking member and said at least one of said links, wherein a toroidal or cylindrical damper member is disposed between the respective linking member and said at least one of said links at a location of said respective clearance, said damper member being made of a material of higher impact resistance than the material of said portion of said at least one of said links.

16. The bracelet as claimed in claim 15, wherein said respective linking member is an articulation pin or an assembly rod having a cross-section having a local reduction at said respective location adjacent said respective open end to obtain said respective clearance.

17. The bracelet as claimed in claim 15, wherein said respective open end has a flaring to obtain said respective clearance.

18. A bracelet comprising:

a plurality of articulated elements, a plurality of links, wherein each of said articulated elements includes at least one of said links, at least one linking member connecting a respective one of said articulated elements with a respective other one of said articulated elements, wherein at least one of said links includes at least one housing including at least one hole, wherein said at least one hole receives therein a respective one of said at least one linking member, wherein said at least one of said links has at least a portion made of a material of low impact resistance which is a ceramic, a sintered hard metal, glass or a mineral, said portion including the at least one housing including the at least one hole, wherein a respective clearance is provided at a respective location adjacent a respective open end of said at least one hole to prevent contact at said respective location between said respective linking member and said at least one of said links, wherein said material of low impact resistance is sapphire or ruby.

19. The bracelet as claimed in claim 18, wherein at least another one of said links has at least a portion made of the material of low impact resistance.

20. The bracelet as claimed in claim 19, wherein said material of low impact resistance is sapphire or ruby.

21. The bracelet as claimed in claim 18, wherein said respective open end has a flaring to obtain said respective clearance.

22. The bracelet as claimed in claim 18, wherein a toroidal or cylindrical damper member is disposed between the respective linking member and said at least one of said links at a location of said respective clearance, said damper member being made of a material of higher impact resistance than the material of said portion of said at least one of said links.

* * * * *